US007144217B2

(12) United States Patent
Gilbert et al.

(10) Patent No.: US 7,144,217 B2
(45) Date of Patent: Dec. 5, 2006

(54) MOLTEN METAL PUMP PARTICLE PASSAGE SYSTEM

(75) Inventors: Ronald E. Gilbert, Spokane, WA (US); Mark A. Palmer, Spokane, WA (US)

(73) Assignee: Pyrotek, Inc., Spokane, WA (US)

( * ) Notice: Subject to any disclaimer, the term of this patent is extended or adjusted under 35 U.S.C. 154(b) by 0 days.

(21) Appl. No.: 10/047,198

(22) Filed: Oct. 26, 2001

(65) Prior Publication Data

US 2003/0147744 A1 Aug. 7, 2003

(51) Int. Cl.
*F04D 29/24* (2006.01)
*F04D 7/06* (2006.01)

(52) U.S. Cl. ..... 415/121.2; 415/206; 416/185; 416/223 B; 416/243

(58) Field of Classification Search ..... 415/121.2, 415/200, 206; 416/223 R, 228, 235, 223 B, 416/185, 243; 417/423.9
See application file for complete search history.

(56) References Cited

U.S. PATENT DOCUMENTS 2,294,135 A * 8/1942 Smith ..... 416/188
4,650,342 A * 3/1987 Goodwin ..... 366/264
5,470,201 A 11/1995 Gilbert et al.
5,634,770 A 6/1997 Gilbert et al.
5,842,832 A * 12/1998 Thut ..... 417/53
5,944,496 A * 8/1999 Cooper ..... 417/423.3
6,468,039 B1 10/2002 Lehman

OTHER PUBLICATIONS

PCT Application No. WO 98/25031, Applicant and Inventor: Cooper.

* cited by examiner

*Primary Examiner*—Ninh H. Nguyen
(74) *Attorney, Agent, or Firm*—Mark W. Hendricksen; Wells St. John, P.S.

(57) ABSTRACT

A molten metal pump system which includes a particle relief passageway between the vanes on the impeller and the pump base, the particle relief passageway being a predetermined size to allow particles of a predetermined size to pass between the plurality of vanes and the interior walls of the impeller aperture of the pump base. Part or all of the particle relief passageway may, but need not, be as a result of a shoulder on the radially outward end of the plurality of vanes in the inlet side of the impeller.

13 Claims, 9 Drawing Sheets

MOLTEN METAL PUMP PARTICLE PASSAGE SYSTEM

CROSS REFERENCE TO RELATED APPLICATION

This application is not related to any other applications.

TECHNICAL FIELD

This invention generally pertains to a molten metal pump particle passage system.

BACKGROUND OF THE INVENTION

Molten metal pumps have been used for years for pumping or moving ferrous and nonferrous molten metal, including without limitation, aluminum.

It is desirable to provide an improved rotor or impeller system for molten metal pumps, including one which provides for the passage of particles of a pre-determined size between the impeller and the pump base.

It is therefore an object of this invention to provide an improved molten metal pump particle passage system.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

The term impeller is used here and is given its ordinary meaning in the industry and may be a rotor, impeller or other device used to move molten metal in a molten metal pump system.

Figure 1:
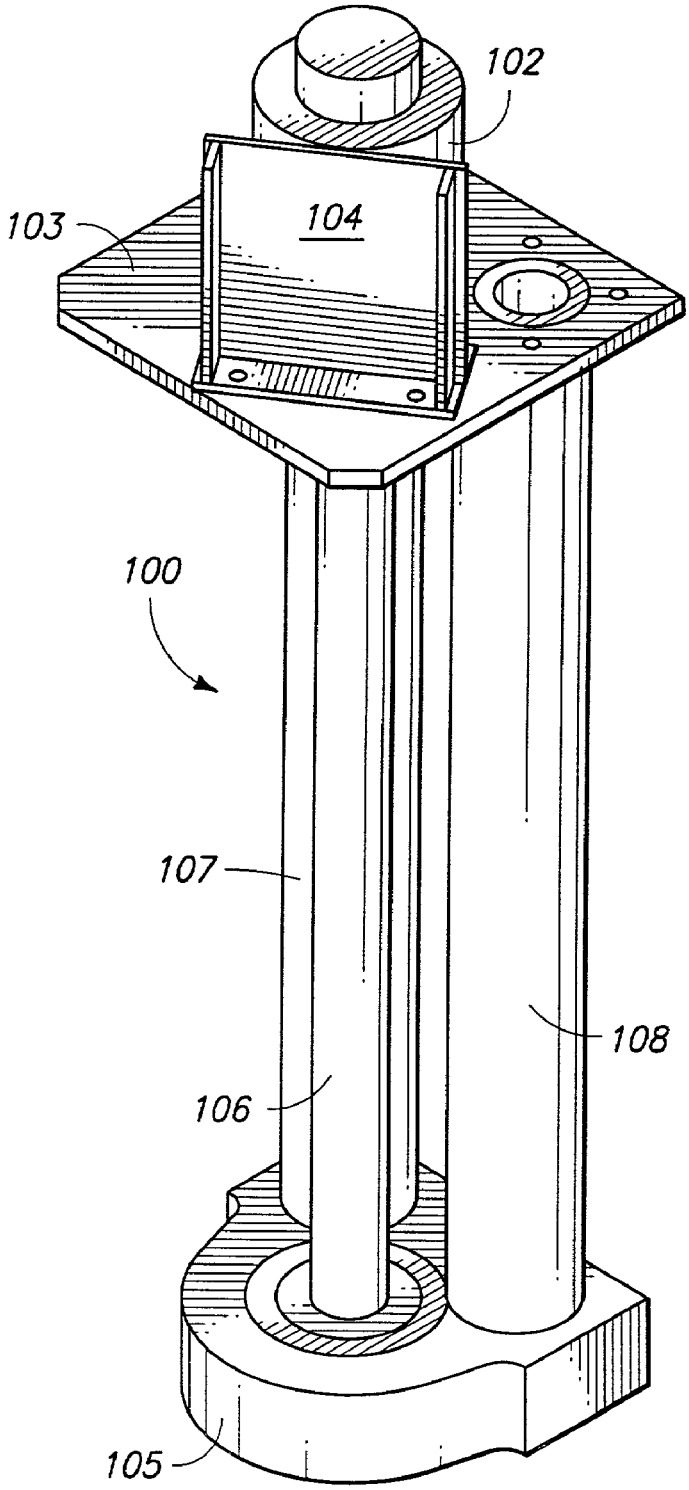
FIG 1 PRIOR ART
FIG. 1 is a front perspective view of a typical prior art molten metal transfer type pump.

FIG. 1 is perspective view of a typical prior art molten metal transfer type of pump, illustrating motor 102, motor mount framework 103, motor mount bracket 104, rotating pump or impeller shaft 106 attached to an impeller housed in pump base 105, which is driven by the motor 102.

The molten metal pump illustrated in FIG. 1 further illustrates an output conduit which is formed in an output conduit body 107 (sometimes referred to as the riser tube), which is typically made of graphite and generally cylindrical with the internal conduit for the pumped molten metal to be pushed through by the impeller. The typical pump components are generally graphite or a form of petroleum coke for use in molten metal aluminum in the aluminum embodiment of this invention, an example of which may be grade CS114 available from Union Carbide.

Although the terms "front side", "back side", "top surface" and "bottom surface" are used herein, they are merely relative terms and meant for orientation of a device as identified. However, this does not limit the invention to "top" being vertical top, but instead the invention may be utilized in any one of a number of different angles or orientations, all within the contemplation of this invention.

Figure 15:
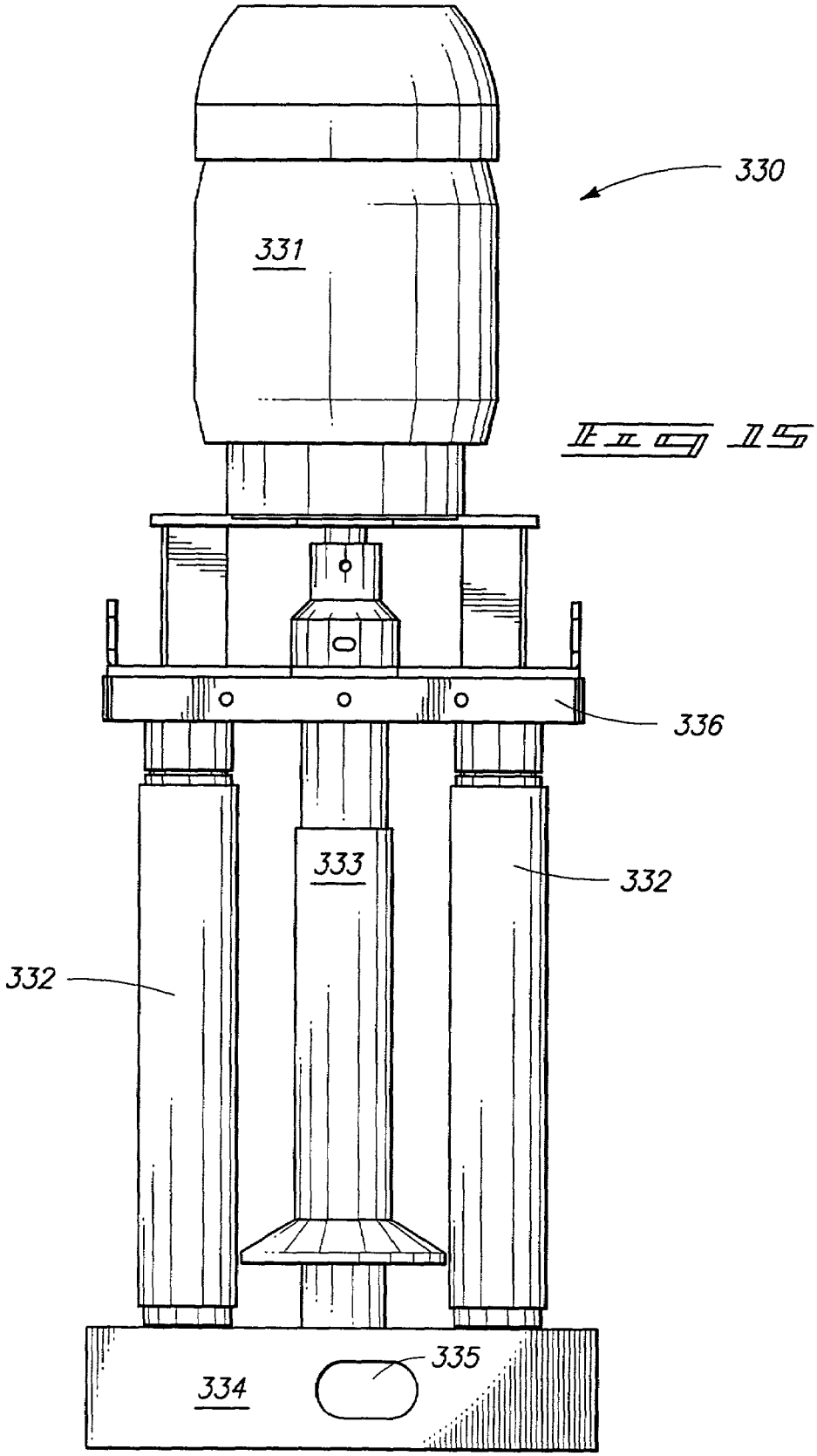

Although a transfer type of pump is shown, this invention is not so limited to a transfer pump, but instead also applies to a number of different types of pumps, such as circulation pumps, which may be preferred. An exemplary circulation pump is illustrated in FIG. 15.

Figure 2:
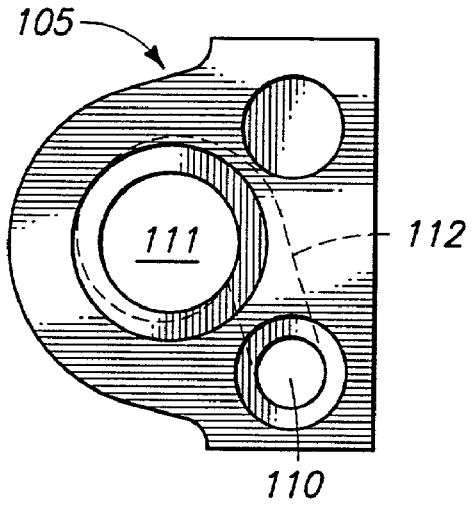
FIG. 2 is a top view of a typical molten metal pump base as shown in FIG. 1.

FIG. 2 is a top view of pump base 105, illustrating impeller aperture 111, output conduit 110 with pump volute 112 also shown.

Figure 3:
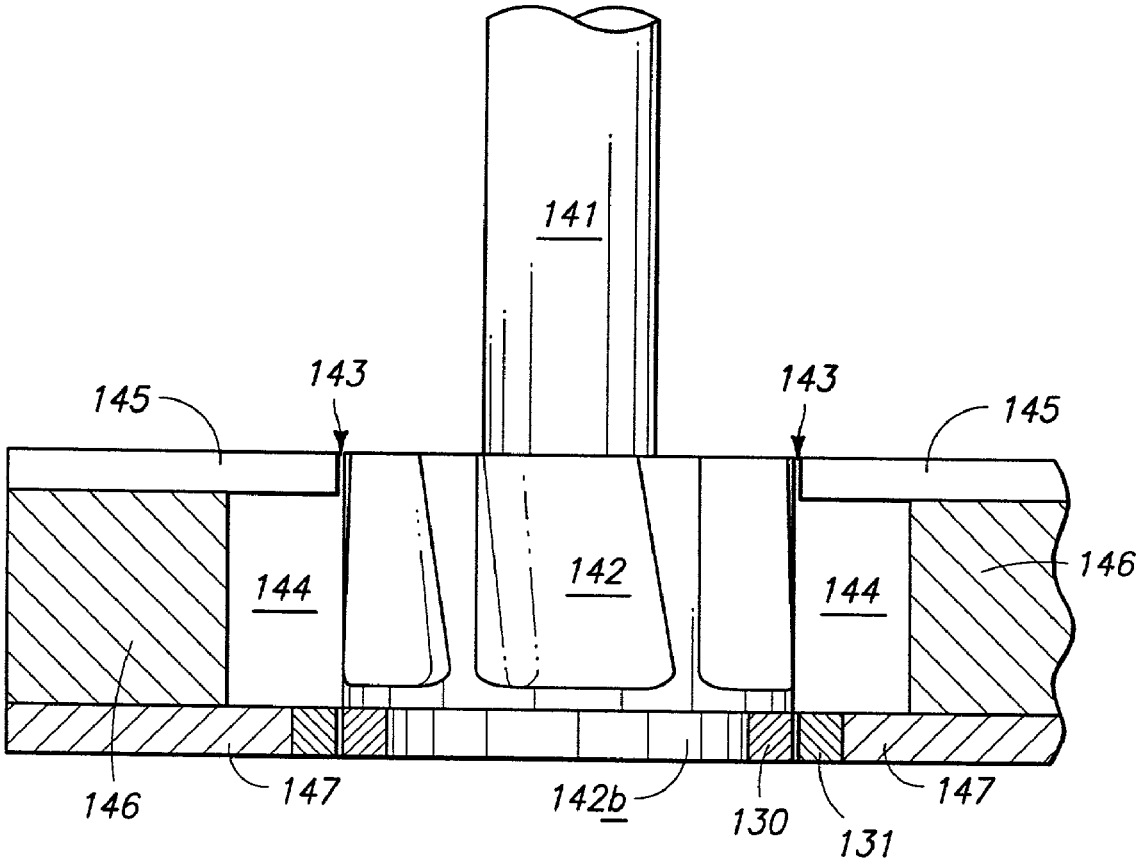
FIG. 3 is an elevation cross-sectional view of an embodiment of an impeller system within a pump base as contemplated by this invention.

FIG. 3 is a cross-section elevation view of an embodiment of an impeller system contemplated by this invention, illustrating impeller system 140, pump or impeller shaft 141, impeller 142 within the pump base 146, which includes base top 145, base bottom 147 and pump chamber 144. Passageway 143 may be an input for molten metal to pass into pump chamber 144. It should be noted that molten metal will also pass between vanes in impeller 142. Base 146 is typically constructed out of graphite or similar material. FIG. 3 further illustrates impeller base **142*b* extending into base bottom 147. The impeller may interact with the base 146** in any one of a number of different ways, such as hardened surfaces, ring inserts, bushings, bearing, or others, all within the contemplation of the invention.

FIG. 3 for instance illustrates what could be a ring 130 around the bottom of impeller 142, which represents a hardened ring which interacts with base ring 131, another hardened ring configured for interaction with ring 130. It should be noted that while rings are shown, they are not necessary to practice this invention or molten metal pumps, as the graphite or other material which used as the base material for the impeller and/or pump base 146 may also be utilized.

Figure 4:
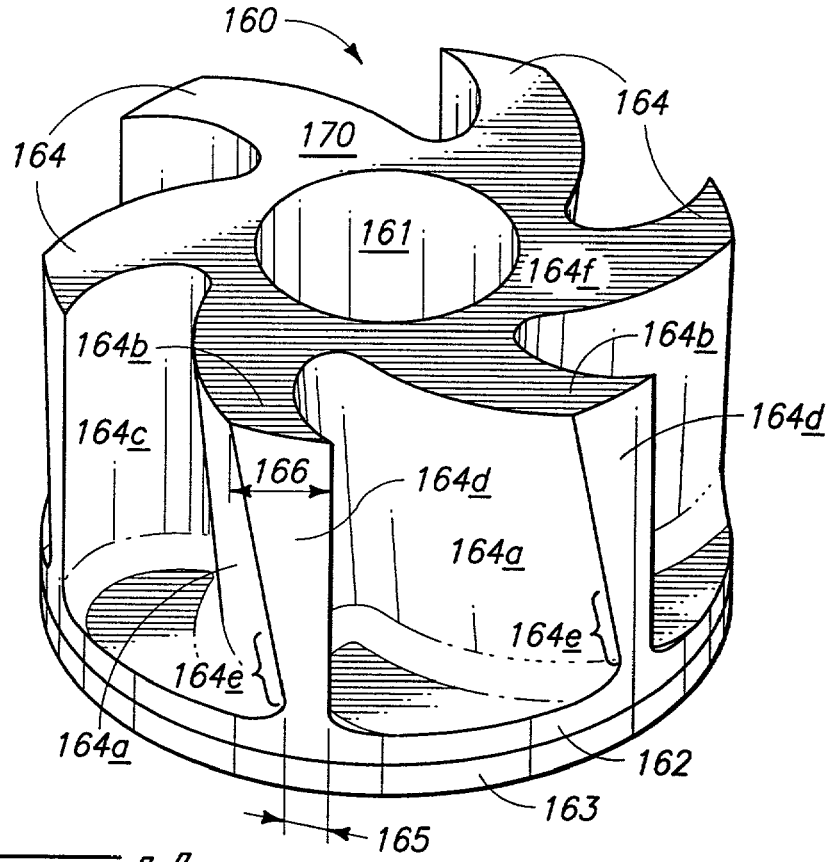
FIG. 4 is a perspective view of one embodiment of an impeller or rotor which may be utilized in this invention.

FIG. 4 is a perspective view of one embodiment of an impeller 160 which may be utilized as part of this invention. FIG. 4 illustrates rotor or impeller 160, impeller vanes 164 and shaft aperture 161 in impeller 160. Impeller base 162 is shown at a lower side of the impeller 160. Impeller vanes 164 include input side 164*b*, output side 164*e*, leading surface 164*a*, trailing surface 164*c*, radially inward end 164*f*, radially outward end 164*d*, with vanes 164 oriented generally radially outward from center portion 170 of impeller 160.

FIG. 4 further illustrates a vane width between leading surface 164*a* and trailing surface 164*c*, which is shown at radially outward end 164*d* as tapered. The vane width 166 at the input side of the vane is wider than vane width 165 at the output side 164*e* or lower end of the vane, near base 162.

Impeller bottom 163 may be inserted into a corresponding aperture in the bottom of the pump base, such as shown more fully with impeller bottom 142*b* inserted into base bottom 147 in FIG. 3.

FIG. 4 further illustrates that leading surface 164*a* is generally convex in shape or configuration, shown in FIG. 4 as an arcuate smooth surface with a convex shape. It is preferred that the leading surface 164*a* be a smooth curve or smooth arc, but it is not required to practice this invention.

The increased surface area on leading surface 164*a* from making it convex provides greater downward force on molten metal passing between respective vanes due to te increased surface area between molten metal being pumped and the leading surface 164*a* on the vane(s). The resulting increase in downward force on the molten metal is believed to increase the efficiency, effectiveness and pumping power of the pump.

While the impeller illustrated in FIG. 4 is shown with six vanes 164, no particular number is necessary to practice this invention as any one of a number of different numbers of vanes may be utilized within the contemplation of this invention.

Figure 5:
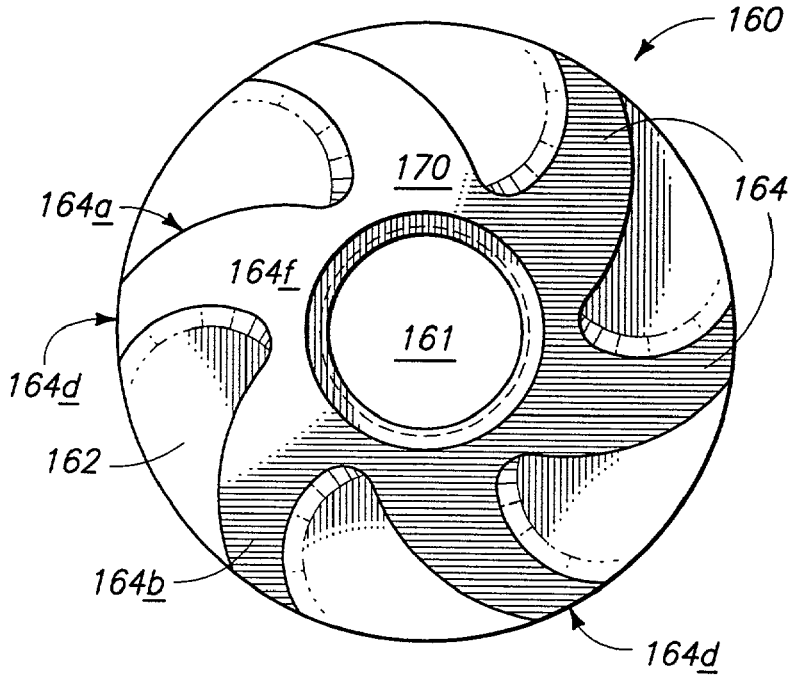
FIG. 5 is a top view of the impeller illustrated in FIG. 4.

FIG. 5 is a top view of the impeller 160 illustrated in FIG. 4, with like numbered items being similarly numbered.

Figure 6:
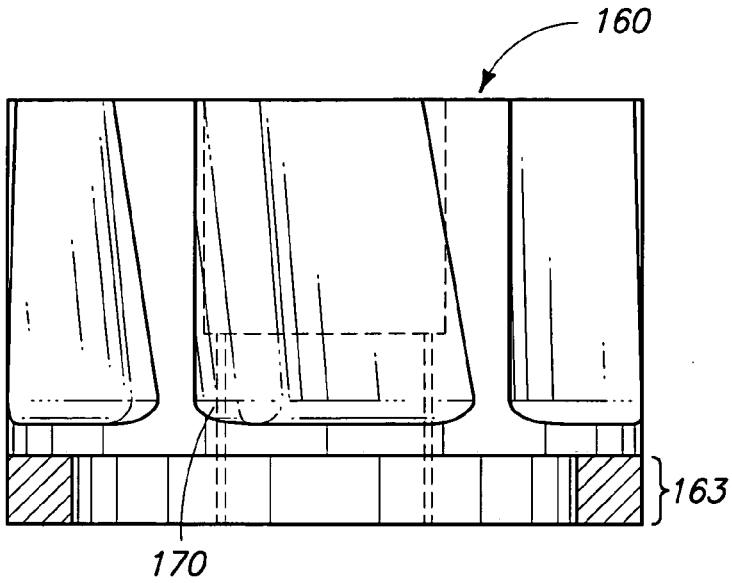
FIG. 6 is an elevation view of the impeller illustrated in FIG. 4.

FIG. 6 is an elevation view of the impeller 160 illustrated in FIG. 4, illustrating impeller bottom 163 and shaft aperture 161. FIG. 6 illustrates the internally threaded portion 170 of shaft aperture 161 (also illustrated in FIGS. 4 and 5). It should be noted and will be appreciated by those of ordinary skill in the art that while a threaded attachment is shown between the impeller shaft and the impeller, this invention is not limited to any particular type of attachment as numerous types are known and practiced in the art. For instance a square, square with arcuate sides, triangular, or others, may be used as part of this invention.

An externally threaded impeller or pump shaft may be inserted into shaft aperture 161 and rotated or threaded into threaded portion 170 to secure the impeller 160 to a pump or impeller shaft.

In the embodiment of the impeller 160 illustrated in FIGS. 4–6, the approximate radius of curvature of leading edge 164*a* is approximately 3.75 inches with the diameter of impeller 160 being approximately 9.625 inches. An exemplary length of trailing surface 164*c* may be approximately one and sixty-five one-hundredths (1.65) inches.

Figure 7:
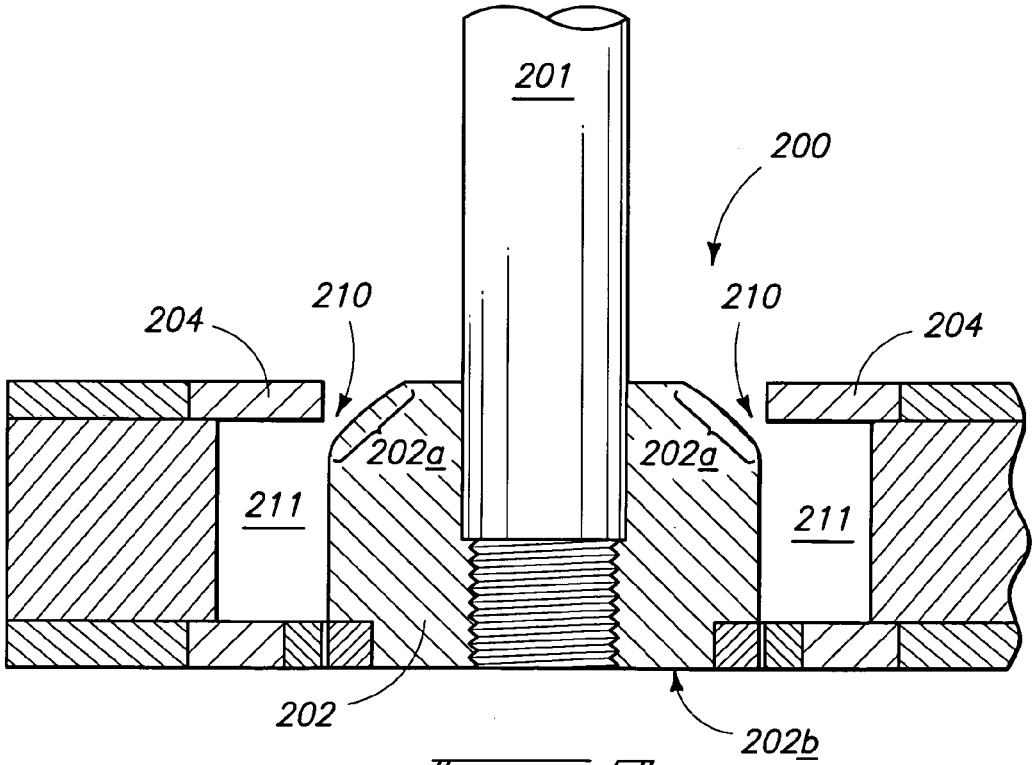
FIG. 7 is an elevation view of another embodiment of an impeller system contemplated by this invention.

FIG. 7 is a cross-sectional elevation view of another embodiment contemplated by this invention, showing impeller system 200, pump or impeller shaft 201, impeller 202 and base 203, with base top 204 and base bottom 205. Impeller shaft 201 is inserted into an impeller aperture in impeller 202 and threaded therein. Impeller bottom 202*b* is inserted into an aperture in the base bottom 205 and rotates therein. Impeller shaft 201 is externally threaded and may be screwed, axially rotated or threaded into internal threads in an aperture in impeller 202 to secure the impeller shaft 201 to impeller 202.

FIG. 7 further illustrates a particle relief passageway 210 between base top 204 and impeller 202. Impeller 202 includes a shoulder 202*a* formed by a tapering of the impeller at the input side, the taper being from the radially inward end to the radially outward end, thereby creating the shoulder 202*a* and proving or defining the particle relief passageway 210.

In applications for this invention, the pump system and impeller system will be used in molten metal environments where particles are present in the molten metal and without a particle relief passageway; the particles may more easily jam or clog the pump. In this invention, depending upon the application, the particle relief passageway will be sized according to the size of particles which are predetermined to be allowed through the particle relief passageway 210, into the pump chamber 211 and then through the pump conduit (not shown in FIG. 7). By appropriately sizing the particle relief passageway 210 based upon the tapering of the impeller vanes, i.e. the creation of a shoulder, the impeller system may effectively be used as a particle relief or a particle screening system in the desired application. This invention may therefore be utilized as a pumping system capable of pumping particles of a predetermined size to further the operations of the molten metal vessel in which the pump is operating, and reduce clog related downtime.

It should be noted that the shoulder is 202*a* is or extends below the top of the base, which contributes to the provision of a particle passageway between the impeller and the base, which in turn allows particles to pass there through. The size of the particles to allow through the inlet and into the pump can by any one of a number of different sizes, but this invention better facilitates predetermining that size. For instance, it may be desirable or preferred to allow particle in the two to three inch size range pass through the pump.

Additionally, the convex leading surface of vanes better facilitates the movement of particles through the pump impeller, as compared to straight or concave shaped leading surfaces on the vanes, which tend to hold up or impede their flow through the impeller and base and through the outlet.

Another contributing factor to the allowance of predetermined particle sizes through the molten metal pump is the size of the outlet port(s) of the pump, which must correspond to that selected or determined for the particle relief passageway.

Figure 8:
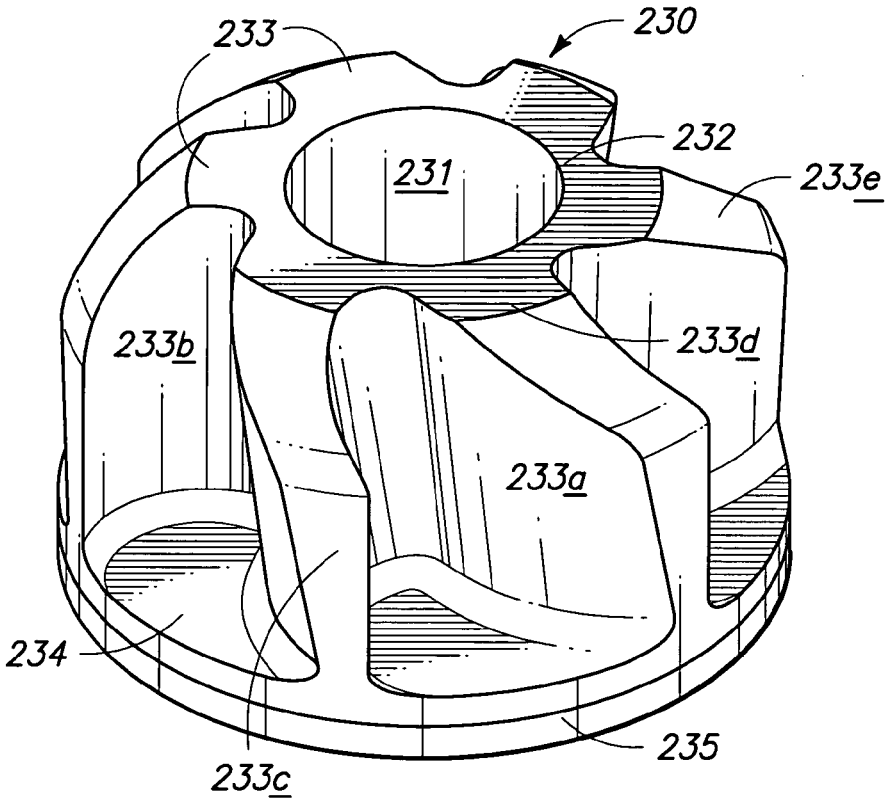
FIG. 8 is a perspective view of one embodiment of an impeller which may be utilized in the embodiment of the invention illustrated in FIG. 7.

FIG. 8 is a perspective view of one example of an impeller 230 which may be utilized as contemplated by this invention and as shown in FIG. 7. FIG. 8 illustrates impeller 230, impeller shaft aperture 231, impeller center portion 232, plurality of vanes 233 with leading surface 233*a*, trailing surface 233*b*, radially inward end, 233*d*, radially outward end 233*c*, base 234 and bottom 235. Each of the plurality of vanes 233 includes a shoulder area 233*e* which is at the input side of the impeller and shows a taper from the radially inward end of the vane to the radially outward end of the vane, thereby creating the shoulder area 233*e*.

It will be appreciated by those of ordinary skill in the art that the degree of taper of the shoulder area 233*e* may be varied relative to the pump base (not shown in FIG. 8) to achieve the predetermined particle relief passageway 210 size (shown in FIG. 7). The leading surface 233*a* of the vanes are shown convexly shaped from the radially inward end 233*d* to the radially outward end 233*c* for increased surface area, and further at an angle toward the downward side to force molten metal flowing between vanes 233 at a downward and radially outward direction.

Figure 9:
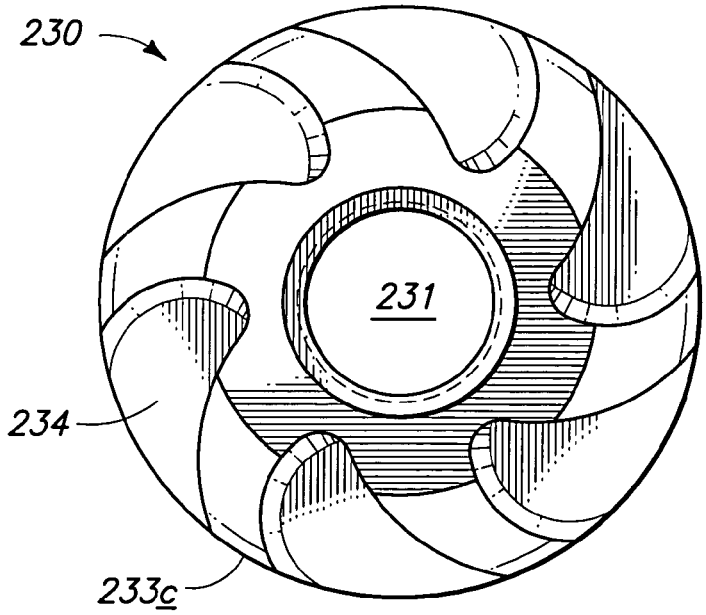
FIG. 9 is a top view of the impeller illustrated in FIG. 8.

FIG. 9 is a top view of the impeller 230 shown in FIG. 8 and like item numbers are used from FIG. 8 and each individual component will not therefore again be discussed in detail.

Figure 10:
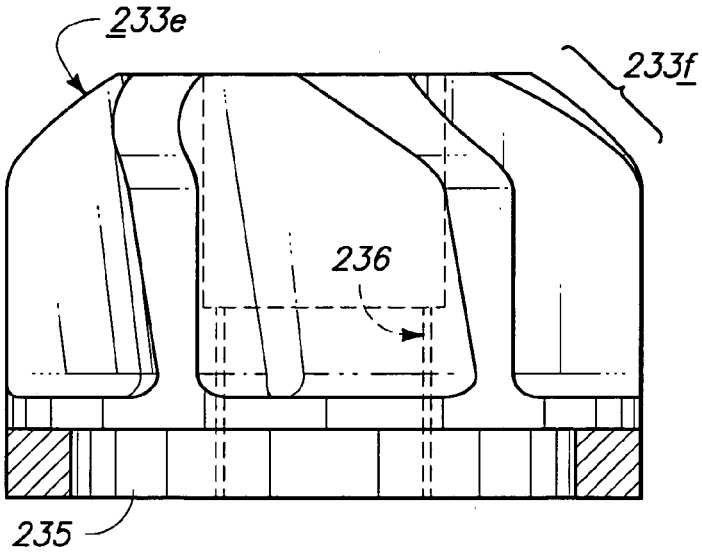
FIG. 10 is a front elevation view of the impeller illustrated in FIG. 8.

FIG. 10 is an elevation view of the impeller 230 illustrated in FIG. 8, and like numbered item numbers are utilized and will not therefore be discussed in detail here. FIG. 10 illustrates vane shoulder area 233*e* with shoulder height 233*f*, illustrating the taper of the vane creating the shoulder and contributing to the creation of the particle relief passageway (shown in other figures). Impeller bottom 235 and threaded portion 236 of the shaft aperture are also shown.

Figure 11:
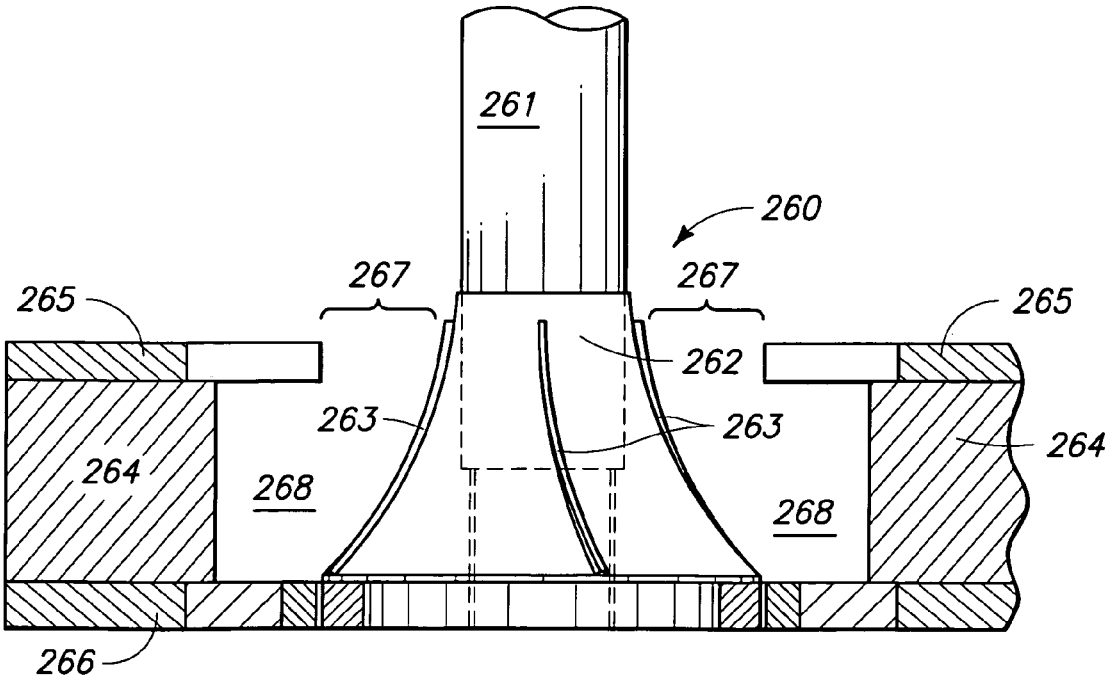
FIG. 11 is a perspective view of another embodiment of an impeller system contemplated by this invention.

FIG. 11 is another example of an embodiment of an impeller system 260 which is contemplated by this invention, illustrating impeller shaft 261, impeller 262, impeller blades 263, pump base 264 with pump base top 265 and pump base bottom 266, and particle relief passageway 267. In this case it should be noted that the impeller 262 may be a smooth conical or semi-conical impeller and the impeller height may be increased to increase the impeller surface area. While impeller fins 263 are shown, the impeller may also be imparted with grooves in place of impeller fins 263 to provide the downward force.

It may be desirable to increase the height of the impeller well above the base top 265 to further increase the surface area, and other structures may be utilized to provide a guard around the top portion of the impeller to further control the particle relief passageway 267 size and ability to pass or screen particles.

Figure 12:
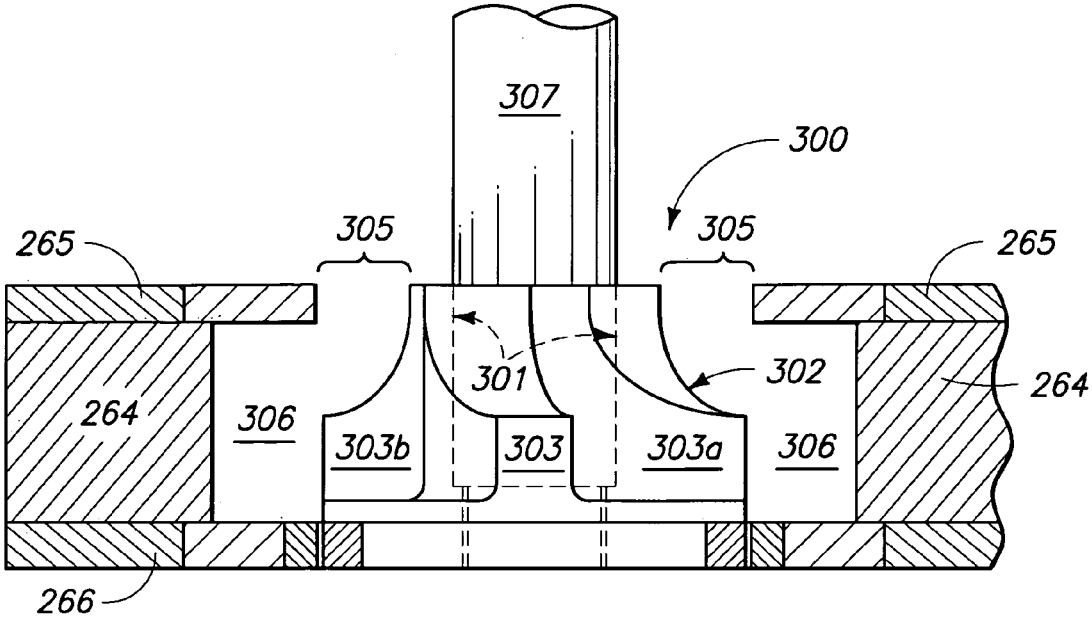
FIG. 12 is a perspective view of yet another embodiment of an impeller system contemplated by this invention.

FIG. 12 is a perspective view of yet another embodiment of an impeller system contemplated by this invention, illustrating an impeller system 300, illustrating impeller shaft 307, impeller 303, impeller blades 303*a*, 303*b*, pump base 264 with pump base top 265 and pump base bottom 266, and particle relief passageway 305.

It may also be desirable in the embodiment to increase the height of the impeller well above the base top 265 to further increase the surface area, and other structures may be utilized to provide a guard around the top portion of the impeller to further control the particle relief passageway 305 size and ability to pass or screen particles.

Figure 13:
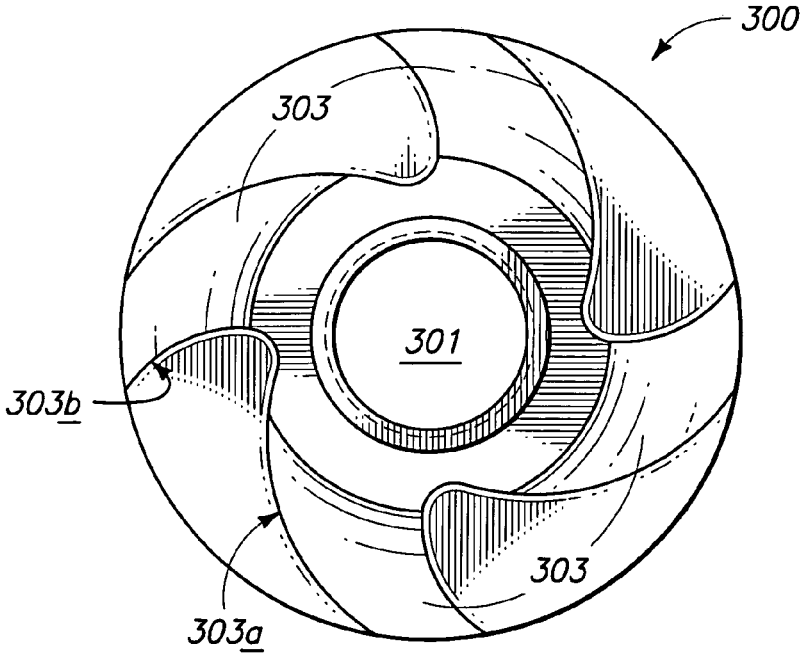
FIG. 13 is a top view of the embodiment of the invention also shown in FIG. 12.

FIG. 13 is a top view of the impeller in the embodiment of the invention shown in FIG. 12, illustrating impeller system 300, impeller vanes 303, impeller shaft 301, leading surface 303*a* and trailing surface 303*b* of impeller vanes 303.

Figure 14:
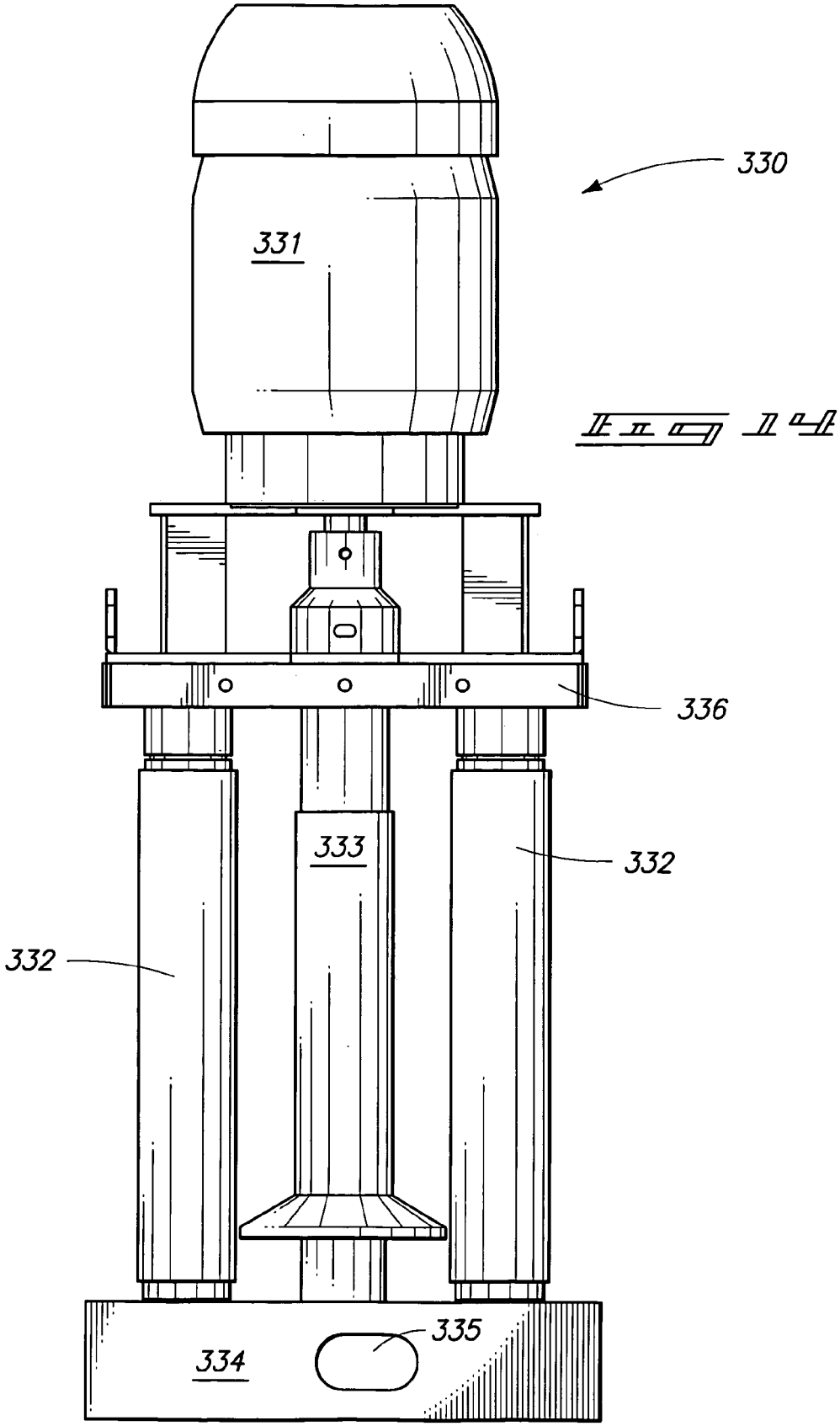
FIG. 14 is a front elevation view of a typical circulation molten metal type pump and in which this invention may be utilized.

FIG. 14 is a front elevation view of a typical circulation molten metal type pump and in which this invention may be utilized, illustrating pump 330, pump motor 331, motor mount 336, support posts 332, impeller shaft 333, base 334 and base outlet aperture 335.

As will be appreciated by those of reasonable skill in the art, there are numerous embodiments to this invention, and variations of elements and components which may be used, all within the scope of this invention.

One embodiment of this invention, for example, is a molten metal pump system comprising: a pump framework; a pump motor mounted on the pump framework; a pump base attached to the pump framework, the pump base including an impeller aperture with interior walls; an impeller shaft attached to the pump motor; an impeller body attached to the impeller shaft and at least partially within the impeller aperture in the pump base, the impeller body comprising: a center portion with a shaft aperture therein; a plurality of vanes extending outward from the center portion, each vane including a radially inward end, a radially outward end, an input side, an output side, a leading surface, a trailing surface, a vane width between the leading surface and the trailing surface; the plurality of vanes being tapered at the input side from the radially inward end to the radially outward end, thereby creating a shoulder on the radially outward end of the plurality of vanes; and wherein a predetermined particle relief passageway is defined between the plurality of vanes on the impeller, the predetermined partial relief passageway being sized to allow particles of a predetermined size to pass between the plurality of vanes and the interior walls of the impeller aperture of the pump base.

A further embodiment of the foregoing would be such a system wherein the impeller body is wholly within the impeller aperture in the pump base.

In another embodiment, a molten metal pump system is provided comprising: a pump framework; a pump motor mounted on the pump framework; a pump base attached to the pump framework, the pump base including an impeller aperture with interior walls; an impeller shaft attached to the pump motor; an impeller body attached to the impeller shaft and at least partially within the impeller aperture in the pump base, the impeller body comprising: a center portion with a shaft aperture therein; a plurality of vanes extending outward from the center portion, each vane including a radially inward end, a radially outward end, an input side, an output side, a leading surface, a trailing surface, a vane width between the leading surface and the trailing surface; the plurality of vanes being tapered at the input side from the radially inward end to the radially outward end, thereby creating a shoulder on the radially outward end of the plurality of vanes; and wherein a predetermined particle relief passageway is defined between the plurality of vanes on the impeller, the predetermined partial relief passageway being sized to allow particles of a predetermined size to pass between the plurality of vanes and the interior walls of the impeller aperture of the pump base.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A molten metal pump system comprising:

a pump framework;

a pump motor mounted on the pump framework;

a pump base attached to the pump framework, the pump base including an impeller aperture with interior walls;

an impeller shaft attached to the pump motor;

an impeller body attached to the impeller shaft and at least partially within the impeller aperture in the pump base, the impeller body comprising:

a center portion with a shaft aperture therein;

a plurality of vanes extending outward from the center portion, each vane including a radially outward end, an input side, and an output side; and wherein a particle relief passageway is defined between the radially outward end of the plurality of vanes on the impeller and the interior walls of the impeller aperture, the particle relief passageway being a predetermined size to allow particles of a predetermined size to pass between the plurality of vanes and the interior wall of the impeller aperture where metal enters between the plurality of vanes and the pump base.

2. A molten metal pump system as recited in claim 1, and further wherein the impeller body is wholly within the impeller aperture in the pump base.

3. A molten metal pump system comprising:

a pump framework;

a pump motor mounted on the pump framework;

a pump base attached to the pump framework, the pump base including an impeller aperture with interior walls;

an impeller shaft attached to the pump motor;

an impeller body attached to the impeller shaft and at least partially within the impeller aperture in the pump base, the impeller body comprising:

a center portion with a shaft aperture therein;

a plurality of vanes extending outward from the center portion, each vane including a radially inward end, a radially outward end, an input side, an output side, a leading surface, a trailing surface, a vane width between the leading surface and the trailing surface; the plurality of vanes being tapered at the input side from the radially inward end to the radially outward end, thereby creating a shoulder on the radially outward end of the plurality of vanes; and wherein a predetermined particle relief passageway is defined between the plurality of vanes on the impeller, the predetermined particle relief passageway being sized to allow particles of a predetermined size to pass between the plurality of vanes and the interior walls of the impeller aperture of the pump base.

4. A molten metal pump system as recited in claim 3, and further wherein the impeller body is wholly within the impeller aperture in the pump base.

5. A molten metal pump impeller system comprising:

an impeller body comprising:

a center portion with a shaft aperture therein;

a plurality of vanes extending outward from the center portion, each vane including a radially inward end, a radially outward end, an input side, an output side, a leading surface, a trailing surface, a vane width between the leading surface and the trailing surface; and wherein the vane width is tapered from the input side to the output side.

6. A molten metal pump impeller system as recited in claim 5, and further comprising an annular base at the output side of the plurality of vanes.

7. A molten metal pump impeller system as recited in claim 6, and further wherein the entire vane width is tapered from the input side to the annular base.

8. A molten metal pump impeller system as recited in claim 5, and further wherein the input side is the vertically upward side.

9. A molten metal pump impeller system as recited in claim 5, and further wherein the plurality of vanes are tapered at the input side from the radially inward end to the radially outward end, thereby creating a shoulder on the radially outward end of the plurality of vanes.

10. A molten metal pump impeller system as recited in claim 5, and further wherein the leading surface is convex.

11. A molten metal pump impeller system comprising:

an impeller body comprising:

a center portion with a shaft aperture therein;

a plurality of vanes extending outward from the center portion, each vane including a radially inward end, a radially outward end, an input side, an output side, a leading surface, a trailing surface, a vane width between the leading surface and the trailing surface and an annular base at the output side of the plurality of vanes;

wherein the vane width includes a taper between the input side and the annular base; and wherein the leading surface is convex.

12. A molten metal pump impeller system as recited in claim 11, and further wherein the input side is the vertically upward side.

13. A molten metal pump impeller system as recited in claim 11, and further wherein the plurality of vanes are tapered at the input side from the radially inward end to the radially outward end, thereby creating a shoulder on the radially outward end of the plurality of vanes.

* * * * *